United States Patent [19]

Woodings

[11] 4,436,285

[45] Mar. 13, 1984

[54] METHOD AND APPARATUS FOR OPENING BLAST-FURNACE TAP HOLES

[76] Inventor: Robert T. Woodings, Box W, Mars, Pa. 16046

[21] Appl. No.: 340,866

[22] Filed: Jan. 20, 1982

[51] Int. Cl.[3] ..... C21C 5/48

[52] U.S. Cl. ..... 266/45; 75/41; 75/42; 266/271

[58] Field of Search ..... 266/45, 271; 75/41, 75/42

[56] References Cited

U.S. PATENT DOCUMENTS

| | | | |
|---|---|---|---|
| 2,005,143 | 6/1935 | Hogg | 266/45 |
| 2,563,131 | 8/1951 | Old | 266/45 |
| 3,201,225 | 8/1965 | Haynes | 75/41 |

*Primary Examiner*—Peter D. Rosenberg

*Attorney, Agent, or Firm*—Thomas H. Murray

[57] ABSTRACT

An improvement upon the apparatus and method disclosed in U.S. Pat. No. 4,273,202. To avoid loss of the drilling bit, a quick-change coupling apparatus is provided between the striking bar, on the one hand, and either the drill rod or poking bar, on the other.

4 Claims, 6 Drawing Figures

METHOD AND APPARATUS FOR OPENING BLAST-FURNACE TAP HOLES

BACKGROUND OF THE INVENTION

1. Field of the Invention:

This invention relates to the art of opening blast-furnace tap holes, and in particular, to a novel improvement in apparatus for drilling tap holes with the use of machinery whereby a drill bit is advanced through a tap hole while it is both rotated and reciprocated in a hammering motion.

2. Description of the Prior Art:

As is known, the hearth of a blast furnace is provided with an iron notch or tap hole through which molten iron is drawn off periodically—usually four or five time a day. The tap hole is plugged with clay or mud at all times except when molten iron is being withdrawn from the furnace. When it is desired to tap the blast furnace, a drill is used to form an opening for the molten iron to be tapped. This is usually a rotary percussion drill, pneumatic or hydraulic. Drilling is continued until the drill encounters a skull of molten iron.

A relatively recent advance in the art of opening iron notches is disclosed in our recently-issued U.S. Pat. No. 4,273,202. In that patent, there is disclosed the use of a hollow drill rod which has mounted on its working end a drill bit through which compressed air is forced in order to dislodge from between the cutting edges of the drill bit the drilled clay. As is disclosed in that patent, the use of such a drill bit and drill rod, together with equipment whereby the drill bit and drill rod are forced into the clay with both a rotary and a reciprocating motion, greatly lessens the amount of time required for the drilling of the tap hole. The above-mentioned patent does not reveal, however, any suitable means or method whereby unintended loss of the drill bit and drill rod may be avoided.

The present invention requires the use of a quick-change or quick-disconnect coupling between the striking bar and the drill rod. It must be admitted that in the mechanical arts, such couplings are well known per se. Prior to the instant invention, however, it has not been obvious to those skilled in the art that very substantial advantages in terms of the convenience, safety and cost of the iron-notch-opening operation may be obtained by the use of this concept in connection with apparatus of the kind indicated above.

SUMMARY OF THE INVENTION

By providing a suitable quick-change coupling between, on the one hand, the striking bar, and on the other hand, either the drill rod or a poking bar, in iron-notch-opening apparatus of the kind wherein clay is removed from a tap hole with a combination of rotary motion and reciprocating motion of a hammering type, there are obtained various advantages. It becomes convenient to pursue the drilling of the tap hole to a desired extent and then, to preserve the drill bit, replace the drill rod and drill bit with a poking bar, the proximal protion of which is fitted (as was the corresponding portion of the drill rod) with a bushing which permits it to be engaged with quick-change coupling means by which it may be driven by the striking bar of the rotating-reciprocating tap hole opening apparatus. Thus, upon opening of the iron notch, only the relatively inexpensive poking bar, or a distal portion thereof, is sacrificed by reason of contact with molten iron.

BRIEF DESCRIPTION OF THE DRAWINGS

A complete understanding of the invention may be obtained from the foregoing and following description thereof, taken in conjunction with the accompanying drawings, in which.

DESCRIPTION OF THE PREFERRED EMBODIMENT

Figure 1:
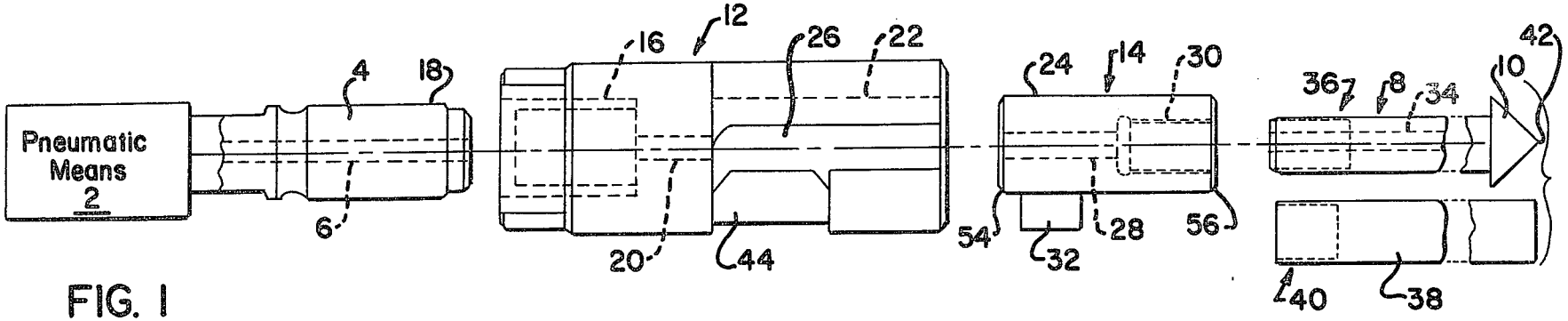
FIG. 1 is an exploded view, partly diagrammatic, of apparatus comprising the invention.

FIG. 1 depicts the combination of various parts which comprise the present invention in its apparatus aspects. There is provided a pneumatic means 2 which causes a striking means 4, as well as the ways of mounting them and the ways of suitably operating them in connection with the drilling of tap holes at the iron notch of a blast furnace, are well known to those skilled in the art. Although the invention is no way necessarily limited to the conditions hereinafter specified, it can be stated that the means 2 has a stroke of 1 to 5 inches, delivers strokes with a frequency of 1500 to 2000 or more blows per minute, and causes the striking bar 4 to rotate at approximately 1 to 200 revolutions per minute.

As is indicated at 6, in a preferred embodiment of the invention, the striking bar 4 is provided with a central internal bore for the passage therethrough of air or other suitable gaseous coolant.

In accordance with the prior art, the striking bar 4 is threadedly connected to a drill rod 8 which is, in turn, threadedly connected to a drill bit 10. Details concerning one suitable and preferred form of drill bit 10 may be found in U.S. Pat. No. 4,273,202.

In accordance with the present invention, and in replacement of the above-mentioned prior art threaded connection between the striking bar 4 and the drill rod 8, there are provided inaccordance with the present invention a quick-change coupling 12 and one or more bushings 14. The coupling 12 is of generally cylindrical form, having at a first end thereof (proximal to the striking bar 4) a suitable bore 16, within which the end 18 of the striking bar 4 may be snugly received. In a central part of the coupling 12, there is a central bore 20, which is preferably adapted to register with the bore 6 in the bar 4, to serve for the passage of coolant air or gas. The end of coupling 12 which is remote from the striking bar 4 has a bore or cavity 22, which is of such dimensions as to permit the end 24 of a bushing 14 to be received snugly therein. The same end of the coupling 12 also has therein a slot or keyway 26.

A bushing 14 is also of generally cylindrical shape having therein a central bore 28 which runs the entire length of the bushing 14 and has at one end, the end remote from the striking bar 4, a portion 30 which is of enlarged diameter and is suitably internally threaded, for a purpose to be discussed hereinbelow.

A further feature of the bushing 14 is a key 32, which is of such dimensions as to permit it to be inserted in the keyway 26 of the coupling 12.

The apparatus according to the invention further includes a drill rod 8, preferably one containing a central bore 34 for the passage of coolant air or gas, and its associated drill bit 10. For simplicity, details concerning how coolant air or gas may enter and pass through the drill bit 10 are not shown, but as those skilled in the art will appreciate, the structure shown in U.S. Pat. No. 4,273,202 may be used. The drill rod 8 has at its proximal end an exteriorly-threaded portion 36, by means of which it may be joined to the portion 30 of the bushing 14.

The apparatus according to the invention also includes a poking bar 38. The poking bar 38 is of elongated cylindrical form, generally having a length approximately equal to that of the drill rod 8 plus its associated drill bit 10, or somewhat longer, if desired, and a diameter which is preferably the same as that of the drill rod 8, or somewhat larger, if desired. It will be apparent to those skilled in the art how to provide bushing to replace the bushing 14, if the diameter of the poking bar is greater than that of the drill rod 8. The bar 38 is also provided at one end with a threaded portion 40, whereby it may be joined to the threaded portion 30 of bushing 14.

In the practice of the invention, the use of two bushings 14 is required; a first one is joined to the drill rod 8 and a second one to the poking bar 38. Further details concerning the invention in its apparatus aspects will be apparent from the following discussion of FIGS. 3–6, inclusive.

Figure 3:
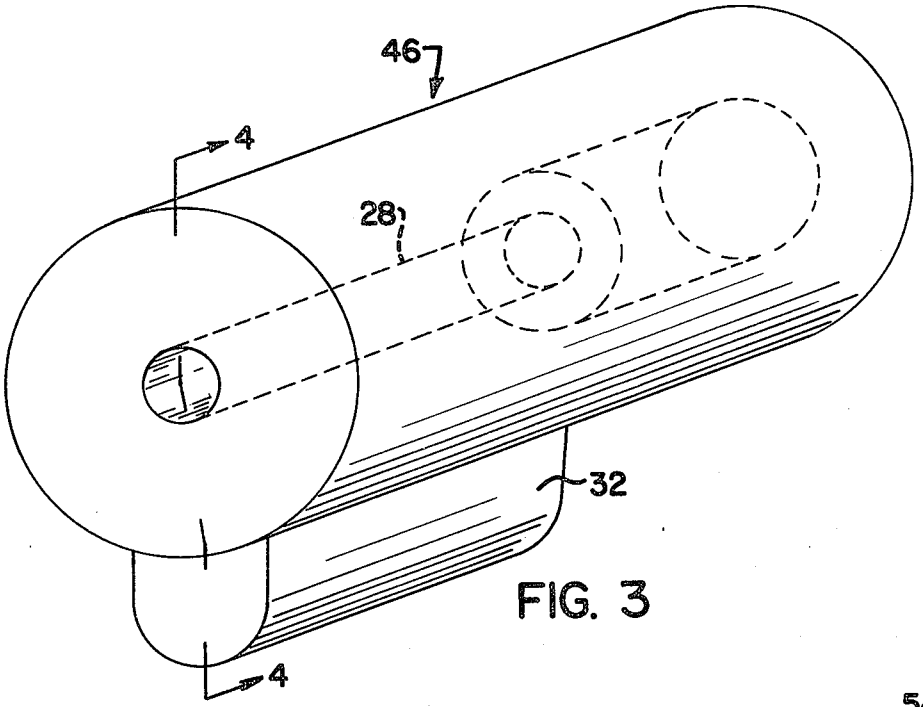
FIG. 3 is a detailed isometric view of a first form of rod bushing blank forming part of the invention.
Figure 4:
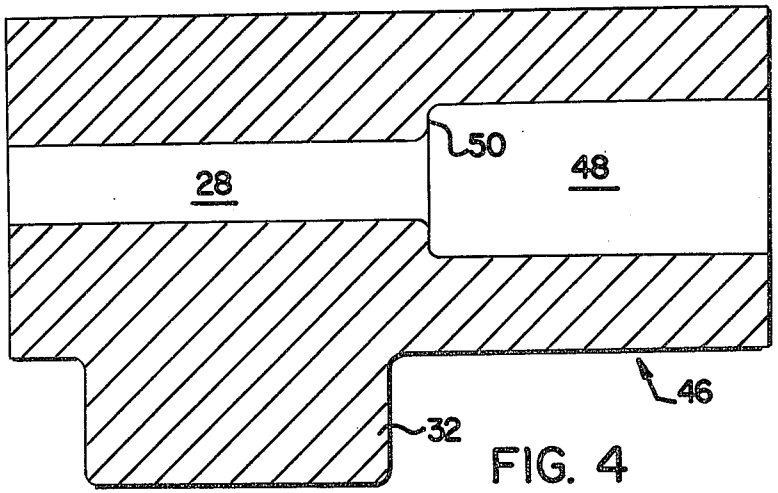
FIG. 4 is a cross-sectional view taken on the line 4—4 of FIG. 3.

FIG. 3 shown, in isometric view, a blank 46 for the making of a rod bushing 14; and in accordance with one way of practicing the invention, the bushing 14 is integral, having been made from a casting or forging such that the key or protuberance 32 is integral with the reminder of the bushing. Those skilled in the art will understand what steps are needed to convert the blank 46 to a bushing 14. The bore 48 needs to be provided with suitable female threads, and near its base 50, there is preferably machined an enlarged portion (see item 52 of FIG. 6) for the receipt of packing (not shown). Comparison of the blank 48 of FIGS. 3 and 4 with the rod bushing of FIG. 1 will also reveal that the ends are chamfered as at 54 and 56 (FIG. 1).

Figure 5:
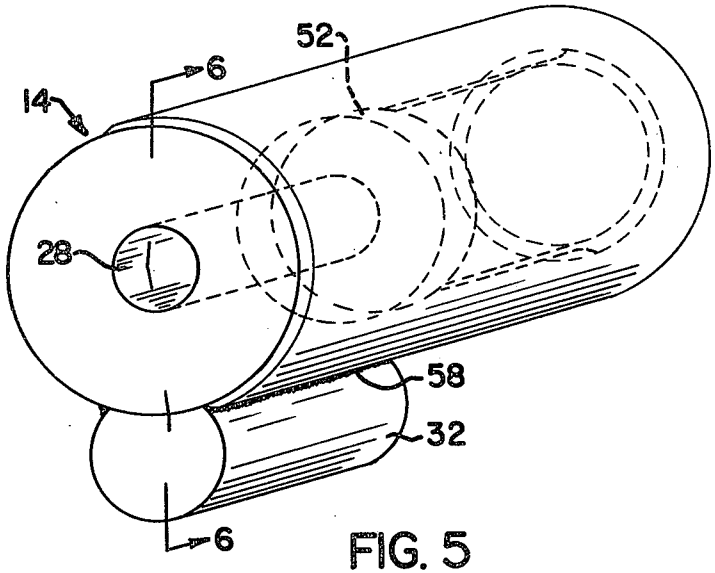
FIG. 5 is a detailed isometric view of an alternate form of rod busing blank forming a part of the invention.
Figure 6:
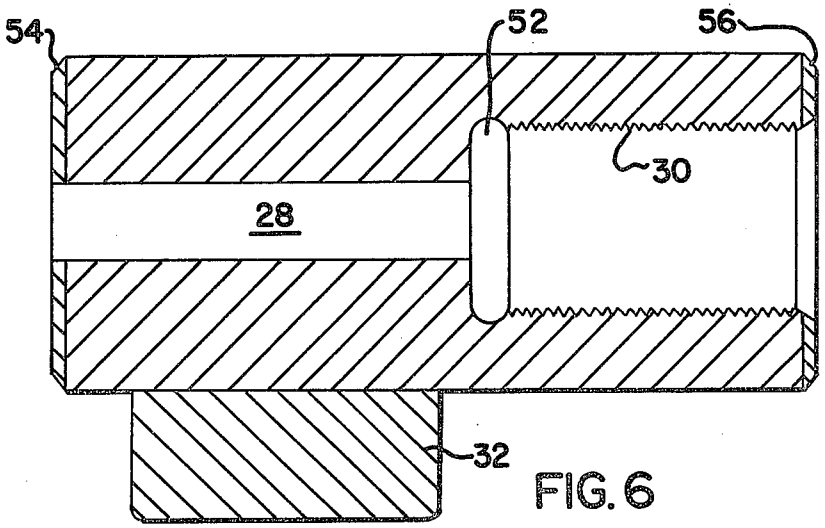
FIG. 6 is a cross-sectional view taken on the line 6—6 of FIG. 5.

An alternative form of a rod bushing, wherein the required key 32 is affixed to the remainder of the bushing 14 by welding, as at 58, is shown in FIGS. 5 and 6.

MODE OF OPERATION

Figure 2:
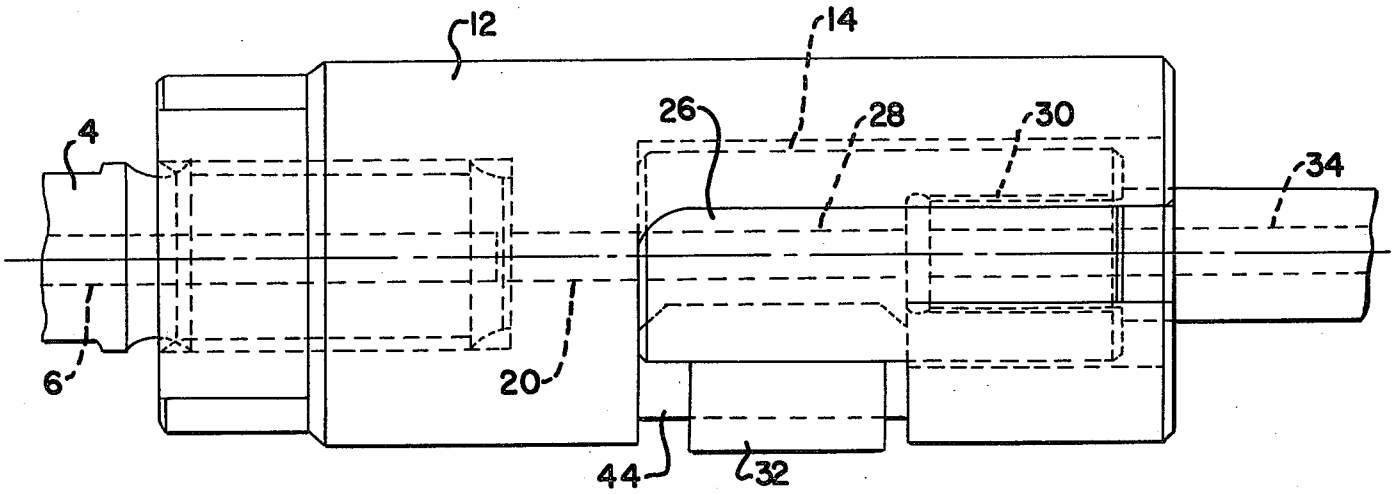
FIG. 2 is an assembly view of a portion of the apparatus of FIG. 1.

Before the opening of a blast-furnace tap hole is commended, an assembly comprising a drill rod 8 and its associated drill bit 10 and bushing 14 is connected to the coupling 12 by inserting the key 32 into the keyway 26 and then rotating the above-mentioned assembly about its longitudinal axis in a direction opposite the direction which the pneumatic means 2 rotates the striking bar 4. In the particular form of apparatus depicted in FIGS. 1 and 2, the pneumatic means 2 rotates the striking bar 4 in a direction clockwise when the apparatus is viewed from point 42. In such case, the connection of the above-mentioned assembly to the coupling 12 involves turning the assembly counterclockwise when viewed from point 42, to cause the key 32 to come to rest against the surface 44 of the coupling 12. In this way, the subsequent usual operation of the means 2, to impart both reciprocating (hammering) and rotating motion to the striking bar 4, causes the assembly comprising the bushing 14, drill rod 8 and drill bit 10 to be rotated clockwise as viewed from point 42, so that there is no danger of uncoupling.

After the equipment has been operated to a desired and suitable extent, i.e., such that the opening of the tap hole is substantially as nearly complete as is feasible (bearing in mind the objective of not losing the drill bit and drill rod because of contact with molten metal), the apparatus of the invention is further manipulated as follows. The assembly comprising a bushing 14 together with its drill rod 8 and drill bit 10 is removed from the coupling 12. Those skilled in the art will understand that it is preferably to back-off the entire assembly of apparatus shown in FIG. 1 by a suitable amount, such as somewhat more than the length of the tap hole opening plus the length of the bushing 14, in order that this may be done. An alternative is to provide the drill rod 8 with means whereby it may be telescoped. Then, the above-mentioned assembly is removed from the coupling 12 by rotating the assembly to align the key 32 with slot 26 and then disengaging the assembly from the coupling 12. To continue with the operation of opening the iron notch, a second assembly comprising a poking bar 38 having an identical or other suitable bushing 14 threadedly attached thereto is inserted in the coupling 12 in the same manner as was the above-mentioned first assembly. Subsequently, the means 2 is so positioned and operated as to cause the end of the poking bar 38 which is remote from the pneumatic means 2 to penetrate the remainder of the material in the blast furnace which closes the iron notch. At this point, molten iron flows out of the iron notch and into a suitable runner, in the usual manner.

Opening the iron notch of a blast furnace in this manner is advantageous in comparison with other alternative modes of operation. In comparison with any method which relies upon the use of an oxygen lance to effect the opening of the tap hole, there is the advantage that a hot and dangerous operation is avoided. In comparison with relying upon the use of the pneumatically-driven drill bit alone, there is the advantage that with the present method, the drill bit is not sacrificed; if anything is ruined, it is only the distal end of the poking bar 38. Moreover, in comparison with known prior-art methods, wherein the drill rod is threadedly connected to the striking bar, there are distinct advantages. It is not necessary to take the time to undo the threaded connection between the striking bar and the rod and to create a threaded connection from the striking bar to a poking bar—a practice which is not only time-consuming but also somewhat perilous, because of the possibility that the iron notch may open itself without poking during the time interval involved. Neither is it necessary, as has been intimated above, to sacrifice the drill bit.

MODIFICATIONS AND EQUIVALENTS

The striking bar 4 may, if desired, be provided with one or more splines which engage suitable slots in the coupling 12, to prevent relative motion (slippage) between the striking bar 4 and the coupling 12.

Although the invention has been shown in connection with a certain specific embodiment, it will be readily apparent to those skilled in the art that various changes in form and arrangement of parts may be made to suit requirements without department from the spirit and scope of the invention.

I claim as my invention:

1. In apparatus for opening the iron notch of a blast furnace, said apparatus comprising:

a striking bar, pneumatic means for imparting rotary motion to said striking bar about its longitudinal axis and reciprocating hammering motion to said striking bar, and a drill rod having a connection to said striking bar, said drill rod having at an extremity thereof remote from said connection a drill bit for removing clay or mud from said iron notch, the improvement wherein:

(a) said connection is of a quick-change type and (b) said apparatus further includes an elongated poking bar having at one end thereof means for securing said poking bar to said connection of a quick-change type.

2. An improvement as defined in claim 1 wherein said quick-change connection is of a pin and bayonet type, the rotary motion imparting to said striking bar serving to prevent uncoupling of said striking bar from said drill rod or said poking bar after a protuberance associated with said rod or bar has been inserted in a slot in said connection and rotated in an angular direction opposite that of the rotary motion of said striking bar about is longitudinal axis while said apparatus is in use.

3. An improvement as defined in claim 1 characterized in that said drill rod and said drill bit are hollow and said apparatus further comprises means for delivering compressed air via said drill rod to and through said drill bit.

4. An improvement as defined in claim 3 wherein said quick-change connection is of a pin and bayonet type, the rotary motion imparting to said striking bar serving to prevent uncoupling of said striking bar from said drill rod or said poking bar after a protuberance associated with said rod or bar has been inserted in a slot in said connection and rotated in an angular direction opposite that of the rotary motion of said striking bar about its longitudinal axis while said apparatus is in use.

* * * * *